US008113557B2

(12) United States Patent
Kirst et al.

(10) Patent No.: US 8,113,557 B2
(45) Date of Patent: Feb. 14, 2012

(54) WIRE GRIPPER JAW DRIVE

(75) Inventors: Michael A. Kirst, Pewaukee, WI (US); Harold J. Keene, Waukesha, WI (US)

(73) Assignee: Artos Engineering Company, Brookfield, WI (US)

( * ) Notice: Subject to any disclaimer, the term of this patent is extended or adjusted under 35 U.S.C. 154(b) by 309 days.

(21) Appl. No.: 12/468,180

(22) Filed: May 19, 2009

(65) Prior Publication Data

US 2010/0295327 A1 Nov. 25, 2010

(51) Int. Cl.
*B66C 1/00* (2006.01)

(52) U.S. Cl. ..... 294/106; 294/192

(58) Field of Classification Search ..... 294/88, 294/106; 901/37; 269/34
See application file for complete search history.

(56) References Cited

U.S. PATENT DOCUMENTS 4,239,273 A * 12/1980 Dodemont et al. ..... 294/88
4,333,676 A * 6/1982 Thumm ..... 294/88
5,853,211 A * 12/1998 Sawdon et al. ..... 294/116
5,904,358 A * 5/1999 Hosono et al. ..... 279/115
6,042,166 A 3/2000 Conte
6,394,521 B1 * 5/2002 Bertini ..... 294/88
6,691,860 B2 * 2/2004 Osterfeld et al. ..... 198/468.2
7,043,825 B2 5/2006 Conte
2008/0073922 A1 * 3/2008 Holtz ..... 294/88

FOREIGN PATENT DOCUMENTS

EP 1447888 A1 2/2004

* cited by examiner

*Primary Examiner* — Saul Rodriguez
*Assistant Examiner* — Stephen Vu
(74) *Attorney, Agent, or Firm* — Andrus, Sceales, Starke & Sawall, LLP

(57) ABSTRACT

A wire gripping assembly is provided with a pair of lever arms that are each movable between a gripping position and a release position. Each lever arm includes a plurality of engagement teeth that interact with drive teeth formed on a moving rack member. The rack member is coupled to a piston movable within an open interior of a drive cylinder. Pressurized air is supplied to either side of the piston to move the piston and rack member. The movement of the piston and the rack member within the drive cylinder results in pivoting movement of the first and second lever arms between the gripping position and the release position.

20 Claims, 8 Drawing Sheets

WIRE GRIPPER JAW DRIVE

BACKGROUND OF THE INVENTION

The present disclosure generally relates to a wire gripping assembly. More specifically, the present disclosure relates to a wire gripping assembly that includes a pair of pivotable lever arms that move between a gripping position and a release position upon the linear movement of a rack member.

Presently, wire gripping assemblies are known and widely used in the processing of wire, including the cutting, stripping and crimping of wire sections.

Wire gripping assemblies typically include gripping jaws that are movable between a gripping position and a release position. When the gripping jaws are in the gripping position, the wire being processed is securely held by the gripping jaws. When the wire section is moved to the desired location, the gripping jaws are separated to release the section of wire being processed.

Currently available wire gripping assemblies include some type of mechanical linkage to move a pair of lever arms between the gripping position and the release position. The mechanical linkage can take many different forms but is typically actuated by some type of air cylinder. In many embodiments, the mechanical linkage creates a significant amount of mass that hinders the movement of the gripper assembly from one location to another. The complex arrangement of the mechanical linkage increases the size of drive member required to move the lever arms and also increases the overall cost and complexity of the wire processing system.

SUMMARY OF THE INVENTION

The present disclosure relates to a wire gripping assembly for use in a wire processing station that cuts, strips and crimps end connectors onto a section of wire. More specifically, the present disclosure relates to a wire gripping assembly that includes an improved drive mechanism that operates to move a pair of lever arms between a gripping position to a release position.

The wire gripping assembly of the present disclosure includes a drive member that causes the movement of a pair of lever arms from a first, gripping position to a second, release position. The drive member is selectively activatable to grip and release sections of wire within a wire processing station.

In one embodiment of the present disclosure, the drive member is a drive cylinder having a generally open interior defined by a cylinder wall. The cylinder wall includes a first fluid inlet and a second fluid inlet that each receive a supply pressurized fluid, such as air. The fluid inlets direct the pressurized fluid into the open interior of the drive cylinder.

The drive cylinder further includes a drive piston that is positioned within the open interior of the cylinder body. The drive piston engages the outer wall of the cylinder body and is positioned between the first fluid inlet and the second fluid inlet. Pressurized fluid supplied to the first fluid inlet causes the piston to move in a first direction while the supply of pressurized fluid to the second fluid inlet causes the piston to move in a second, opposite direction.

The wire gripping assembly includes a rack member mounted to the drive piston and movable along with the drive piston. The rack includes a series of drive teeth. The rack member, along with the drive piston, is movable along a linear movement axis within the open interior of the drive cylinder.

The wire gripping assembly includes first and second lever arms that are each pivotally mounted relative to the drive member. The first and second lever arms each include a first end having a series of engagement teeth. The engagement teeth formed on the first end of each of the lever arms mesh with the drive teeth formed on the rack member. When the rack member is moved along the linear movement axis, the engagement between the drive teeth on the rack member and the engagement teeth on the lever arm causes the lever arms to pivot about pivot pins. The pivot pins each define a pivot axis that is generally perpendicular to the linear movement axis of the drive piston and the associated rack member. Preferably, the pivot axis of each of the two lever arms are located on opposite sides of the linear movement axis of the drive piston and the associated rack member.

Each of the first and second lever arms are configured to include a gripper jaw that engages the wire being handled when the lever arms are in their engagement position. When the lever arms are in the release position, the gripper jaws separate to release the section of wire. The first and second lever arms can be configured in different orientations depending upon the type of movement of the wire section when the wire section is gripped by the gripper jaws.

Various other features, objects and advantages of the invention will be made apparent from the following description taken together with the drawings.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
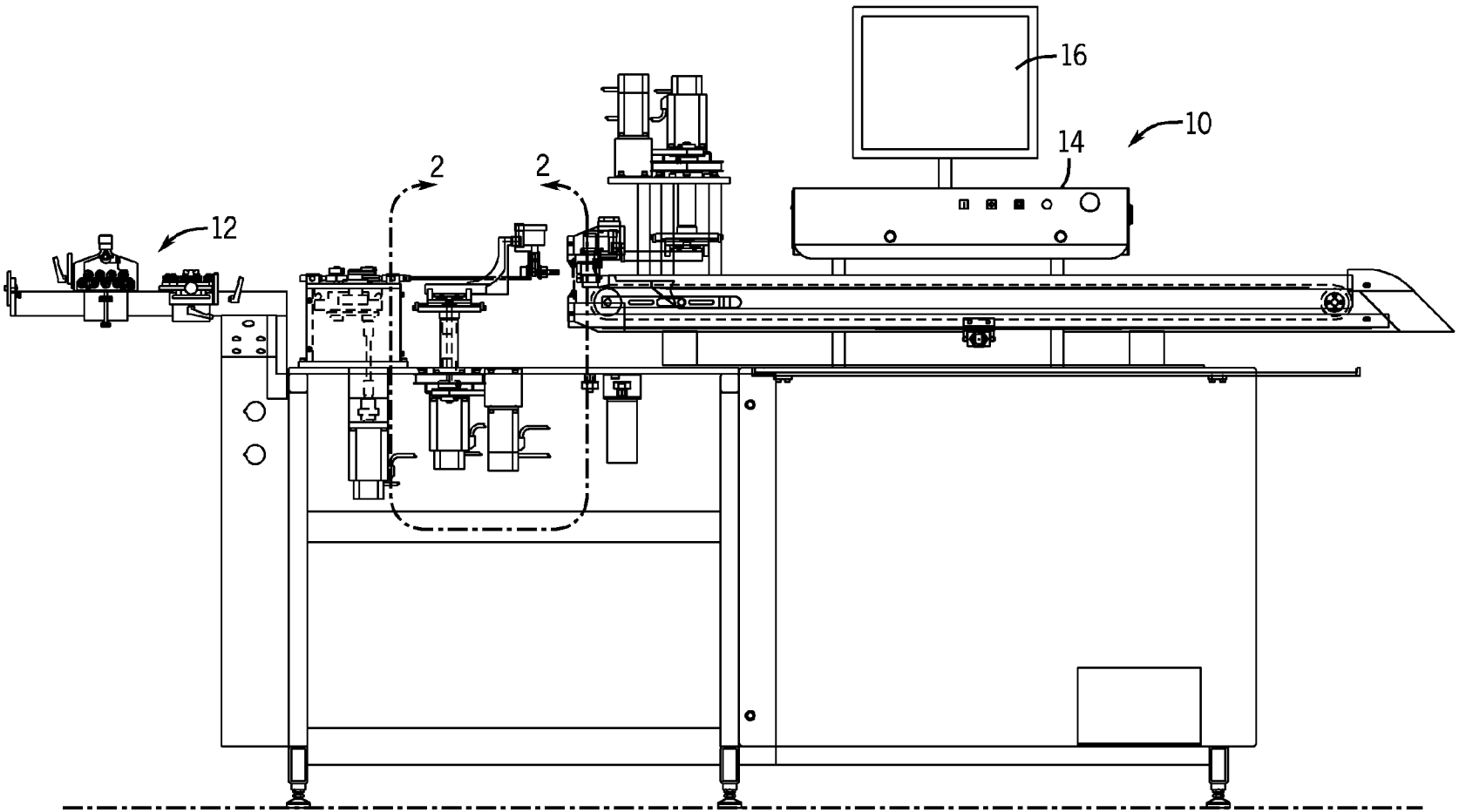
FIG. 1 is a side view of a wire stripping and crimping system that incorporates the wire gripping assembly of the present disclosure.

FIG. 1 generally illustrates a wire processing system 10. The wire processing system 10 includes an infeed section 12 that draws a supply of wire into the remaining portions of the system which cuts the wire to length, strips the ends and performs any array of processes to either or both ends of the cut wire section. These processes include and are not limited to crimping, sealing, tinning, twisting, doubling and welding. The wire processing system 10 is controlled by a control unit 14 having a display 16. The operation of the wire processing station 10 is well known to those of ordinary skill in the art such that the details of the operation will not be described herein.

Figure 2:
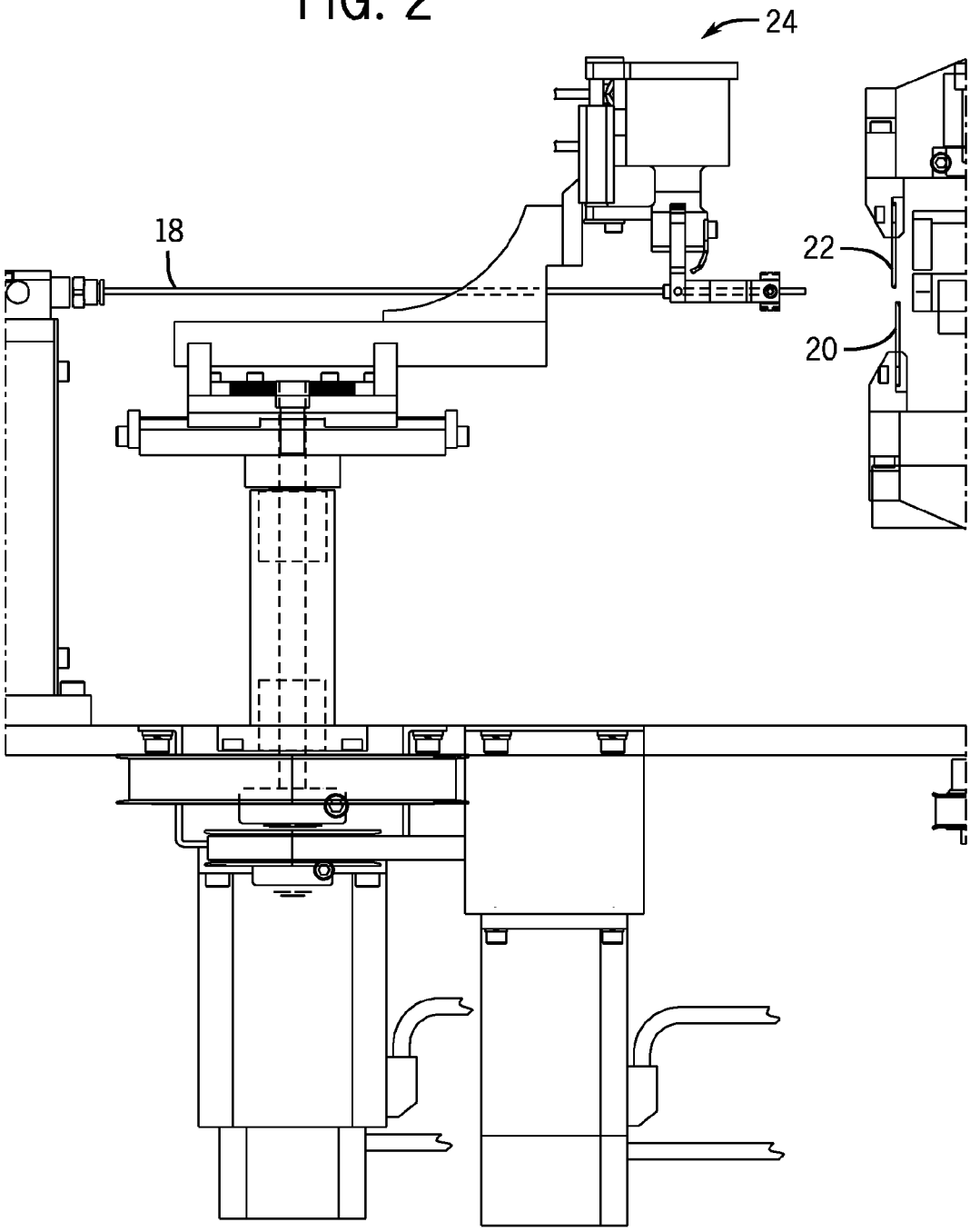
FIG. 2 is a magnified view of the wire gripping assembly taken along line 2-2 of FIG. 1.

FIG. 2 illustrates a portion of the wire processing system that grabs a section of wire 18 and directs the wire section to a pair of wire cutting and stripping blades 20, 22. The system includes a wire gripping assembly 24 that is selectively operable to grasp the wire section 18 and move the wire section 18 into a desired location. Once again, the movement of the wire gripping assembly 24 to effect the wire cutting and stripping operation is well known to those of ordinary skill in the art. The present disclosure is directed to the specific configuration of the wire gripping assembly 24 shown in FIG. 2.

Figure 3:
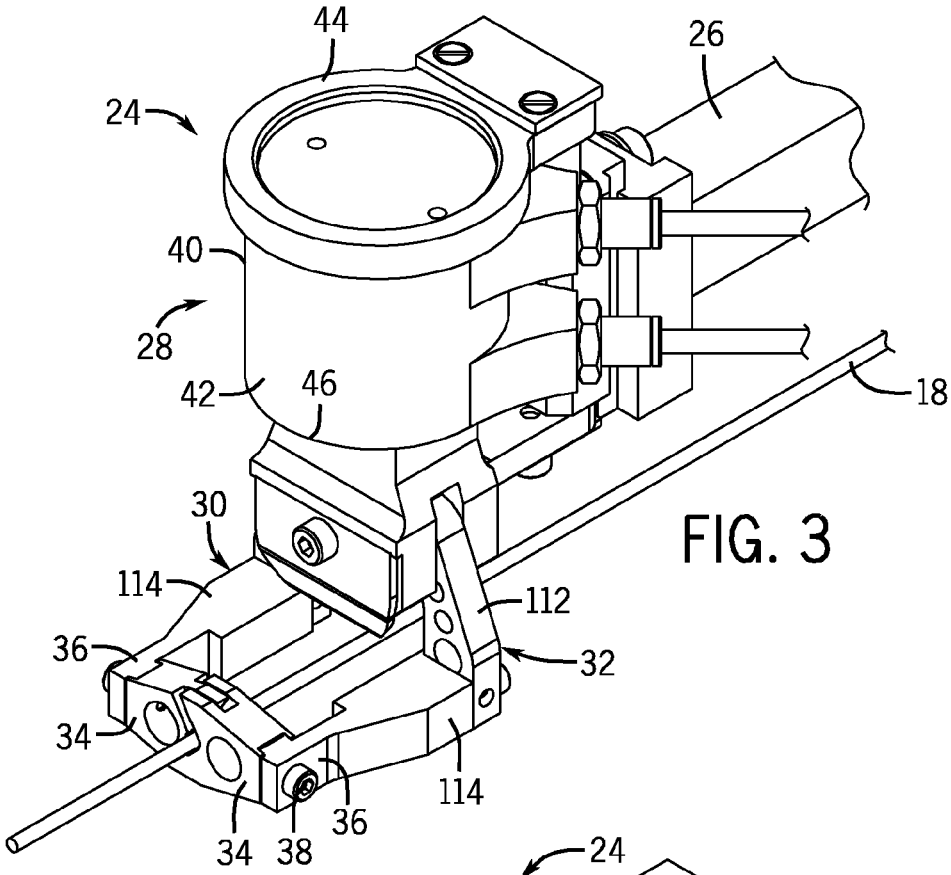
FIG. 3 is a front perspective view of the wire gripping assembly shown in the gripping position.

FIG. 3 illustrates the wire gripping assembly 24. The wire gripping assembly 24 is mounted to a support arm 26 such that the entire wire gripping assembly 24 can move to a desired location. The wire gripping assembly 24 generally includes a drive member 28 that controls the movement of a first lever arm 30 and a second lever arm 32 between the gripping position shown in FIG. 3 and the release position shown in FIG. 4. In the embodiment shown in FIGS. 3 and 4, both the first lever arm 30 and the second lever arm 32 include a gripper jaw 34 attached to a second end 36 of the respective first and second lever arms 30, 32. The gripper jaws 34 are each removably attached to the lever arms 30, 32 by a connector 38. However, it is contemplated that the gripper jaws 34 could be permanently attached to the first and second lever arms 30, 32 while operating within the scope of the present disclosure.

As illustrated in FIG. 3, when the first and second lever arms 30, 32 are in the gripping position, the wire section 18 is grasped between the pair of gripper jaws 34. In the release position of FIG. 4, the gripper jaws 34 are lifted upwards and away from the wire section 18 such that the wire gripping assembly 24 releases the wire section 18.

Figure 4:
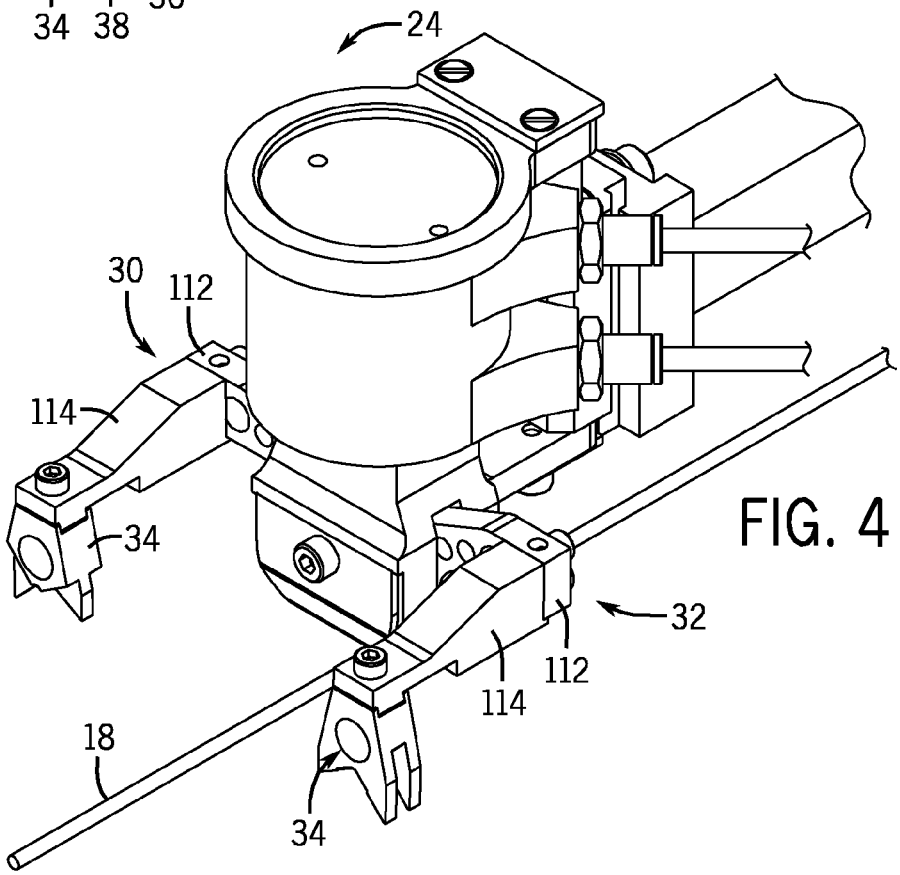
FIG. 4 is a view similar to FIG. 3 illustrating the wire gripping assembly in the release position.

In the embodiment shown in FIGS. 3 and 4, the drive member 28 includes a drive cylinder 40 having a body 42 extending from a first end 44 to a second end 46.

Figure 5:
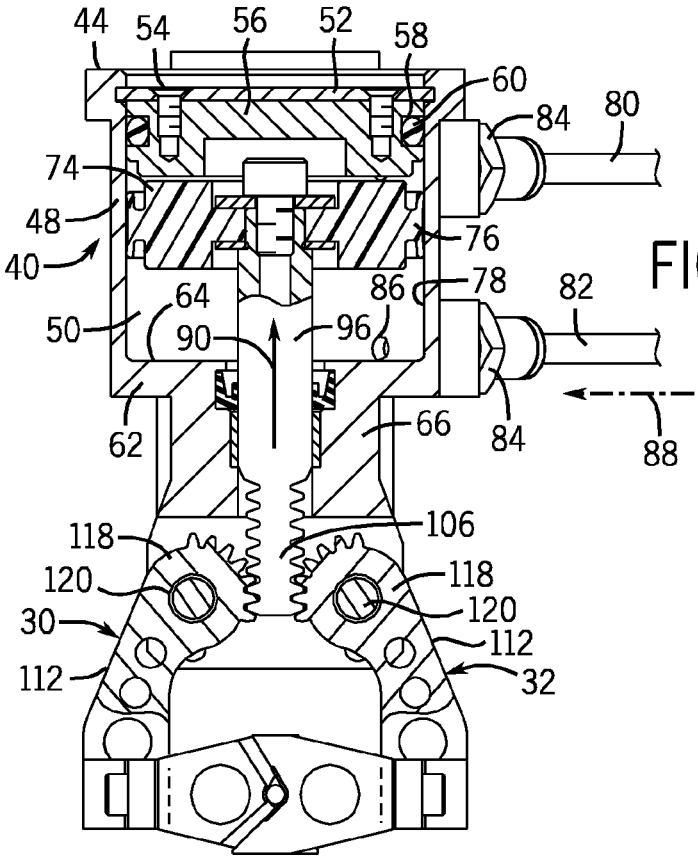
FIG. 5 is a section view of the wire gripping assembly shown in FIG. 3.

Referring now to FIG. 5, the drive cylinder 40 includes an outer wall 48 that defines a generally cylindrical open interior 50. The first end 44 of the drive cylinder 40 receives a cover member 52. The cover member 52 includes a pair of connectors 54 that secure the cover member 52 to a plug 56. The plug 56 includes a recessed groove 58 that in turn receives an annular sealing member 60.

Figure 7:
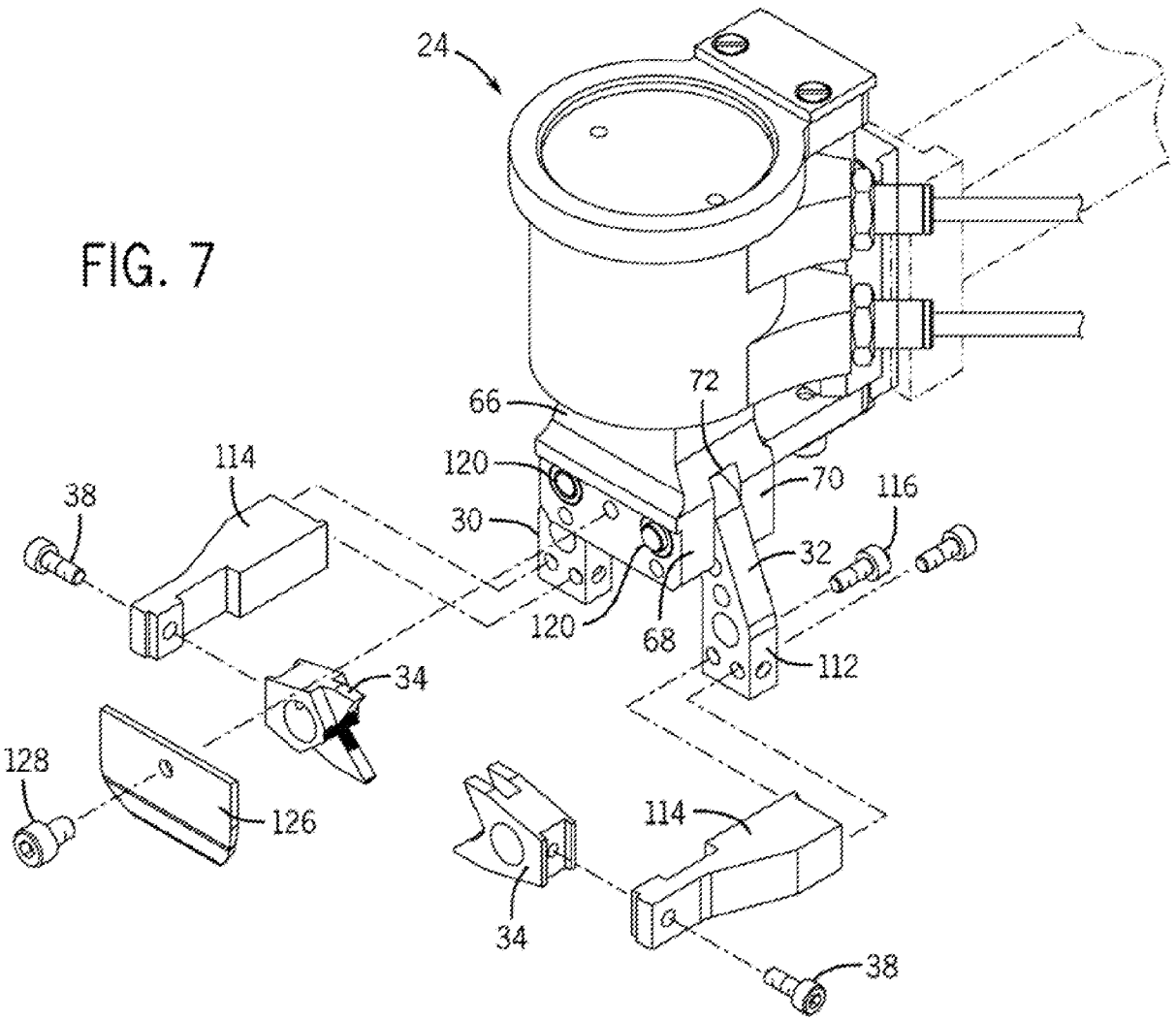
FIG. 7 is a partially exploded view of the wire gripping assembly of FIGS. 3-4.

The outer wall 48 transitions into a base wall 62 that defines the bottom surface 64 of the open interior 50. Base wall 62 includes a mounting section 66 having a front wall 68 and a back wall 70, as best shown in FIG. 7. The front wall 68 and back wall 70 are spaced from each other by an open channel 72 which receives the first lever arm 30 and the second lever arm 32, as will be described in detail below.

Referring back to FIGS. 5 and 6, the drive cylinder 40 includes a piston 74 positioned within the open interior 50. The piston 74 includes an outer seal 76 that engages the inner wall 78.

Figure 6:
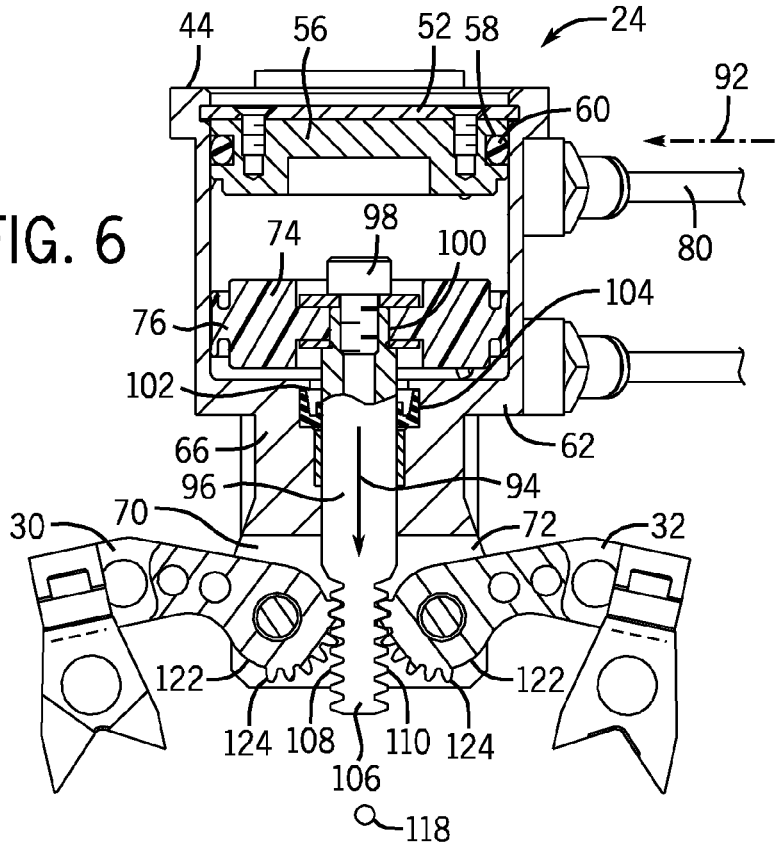
FIG. 6 is a section view of the wire gripping assembly shown in FIG. 4.

As illustrated in FIGS. 5 and 6, the piston 74 is movable between an upper position shown in FIG. 5 and a lower position shown in FIG. 6. The movement of the piston 74 between the upper position and the lower position is controlled by the application of pressurized air through a first air hose 80 and a second air hose 82. Both of the air hoses 80, 82 include a fitting 84 that allows the pressurized air within the respective air hose 80, 82 to be directed through an opening 86 within the open interior 50. As can be understood in FIG. 5, when pressurized air is supplied through the air hose 82, as illustrated by arrow 88, the piston 74 moves to its upper position, as indicated by arrow 90. Referring now to FIG. 6, when pressurized air is supplied through the air hose 80, as illustrated by arrow 92, the pressurized air above the piston 74 causes the piston to move downward, as illustrated by arrow 94. As can be understood in FIGS. 5 and 6, the application of pressurized air through the air hoses 80, 82 controls the movement of the piston 74 from the upper position of FIG. 5 to the lower position of FIG. 6.

Referring now to FIG. 6, the wire gripping assembly 24 includes a rack member 96 securely attached to the piston 74. A connector 98 is threadedly received in an upper attachment portion 100 of the rack member 96. The rack member 96 extends through a cylindrical opening 102 formed in the base wall 62. The rack member 96 extends through the entire mounting section 66 and into the open channel 72 formed between the front and back walls 68, 70, formed as part of the mounting section 66. In the embodiment illustrated, a sealing member 104 surrounds the main body of the rack member 96 to prevent pressurized air from flowing around the rack 96.

As illustrated in FIGS. 5 and 6, the rack member includes a drive section 106 having a first series of drive teeth 108 and a second series of drive teeth 110. In the embodiment illustrated, the first and second series of drive teeth 108, 110 are identical to each other. However, it is contemplated that the configuration of the drive teeth 108, 110 could be varied while operating within the scope of the present disclosure.

When the piston 74 moves from the upper position shown in FIG. 5 to the lower position shown in FIG. 6, the entire rack member 96 moves along a linear movement axis generally illustrated by the arrows 90, 94. As described previously, the application of pressurized air through the air hoses 80, 82 controls the movement of the piston 74 within the open interior 50.

In the embodiment illustrated in FIGS. 3 and 4, each of the first and second lever arms 30, 32 includes a first section 112 and a second section 114. As illustrated in FIG. 7, the second section 114 is secured to the first section 112 by a pair of connectors 116. However, it is contemplated that the first and second sections 112, 114 could be integrally formed with each other while operating within the scope of the present disclosure.

Referring now to FIGS. 5 and 6, the first section 112 of both the first lever arm 30 and the second lever arm 32 includes a first end 118 mounted to the mounting section 66 by a pivot pin 120. The pivot pin 120 defines a pivot axis extending into the Figure perpendicular to the linear movement axis illustrated by arrow 90. As illustrated in FIG. 7, each of the pivot pins 120 extends through both the front wall 68 and the back wall 70 and defines the pivot axis for the first lever arm 30 and the second lever arm 32.

Referring back to FIGS. 5 and 6, the first end 118 of both of the first and second lever arms 30, 32 includes a radiused movement surface 122. Each of the movement surfaces 122 include a plurality of engagement teeth 124. The engagement teeth 124 on the first lever arm 30 engage the first set of drive teeth 108 while the engagement teeth 124 on the second lever arm 32 engage the second set of drive teeth 110 formed on the rack member 96. The spacing between the engagement teeth 122 and the first and second set of drive teeth 108, 110 is identical to provide smooth interaction between the mating teeth.

As the rack member 96 moves downward, as indicated by arrow 94 in FIG. 6, the downward movement of the rack member 96 causes the first and second lever arms 30, 32 to pivot from the gripping position of FIG. 5 to the open position of FIG. 6. Conversely, when the rack member 96 moves upward in the direction shown by arrow 90 in FIG. 5, the movement of the rack member 96 causes the first and second lever arms 30, 32 to move from the open position shown in FIG. 6 to the closed, gripping position shown in FIG. 5. As described, the application of pressurized air through the air hoses 80, 82 moves the piston 74, which in turn results in movement of the rack member 96. The interaction between the drive teeth 108, 110 on the rack member and the corresponding engagement teeth 124 on the first end of the first and second lever arms 30, 32 results in the movement of the first and second lever arms 30, 32 between the gripping position of FIG. 5 and the release position of FIG. 6.

Referring now to FIG. 7, the wire gripping assembly 24 includes a cover plate 126 attached to the front wall 68 by a connector 128. The cover plate 126 covers the pair of pivot pins 120.

Figure 8:
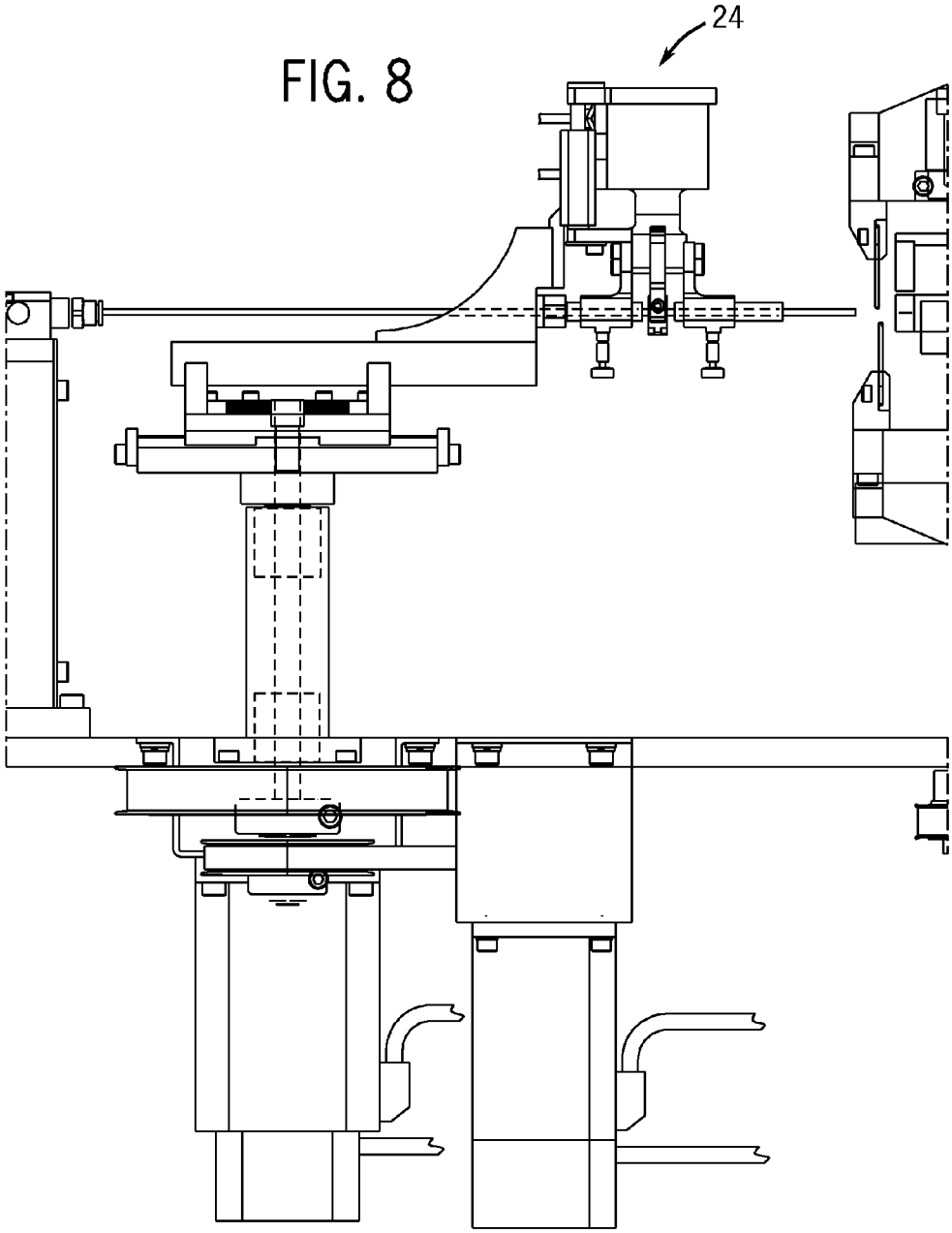
FIG. 8 is a magnified view of a second configuration for the wire gripping assembly.

FIG. 8 illustrates a second configuration of a wire gripping assembly 24 constructed in accordance with the present disclosure. The second configuration shown in FIG. 8 includes many of the same operating components as the first configuration of FIGS. 1-7, as will be described in greater detail below.

Figure 9:
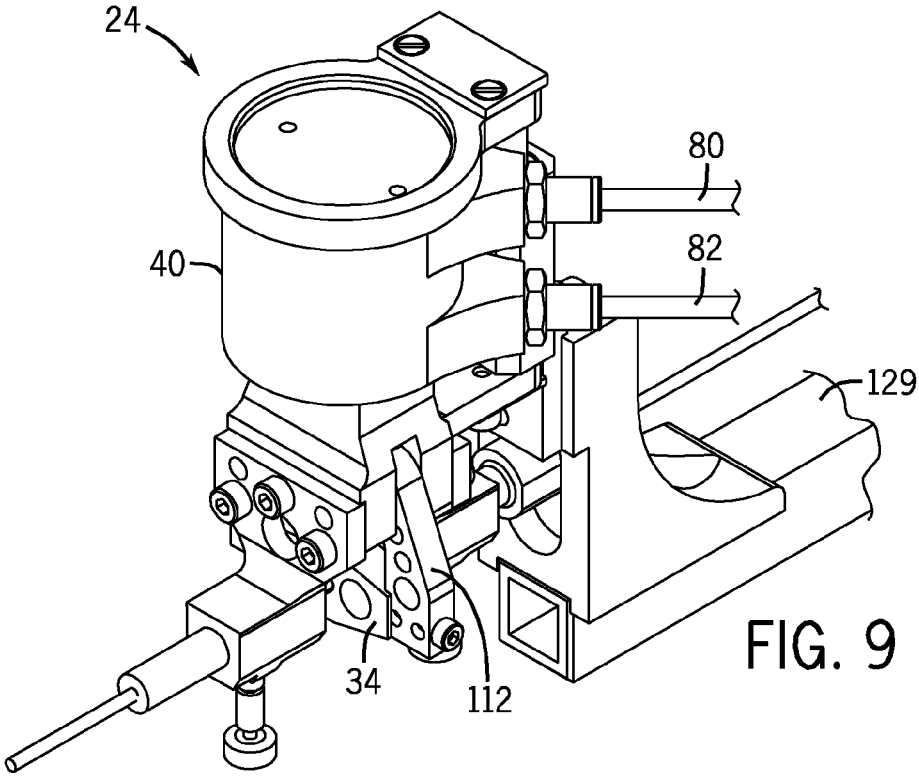
FIG. 9 is a front perspective view of the second configuration in the gripping position.

As illustrated in FIG. 9, the second configuration of the wire gripping assembly 24 includes a modified mounting arrangement 129. However, the wire gripping assembly 24 includes an identical drive cylinder 40 including the pair of air hoses 80, 82. The internal operation of the drive cylinder 40 is identical to that described with reference to FIGS. 5 and 6.

Figure 10:
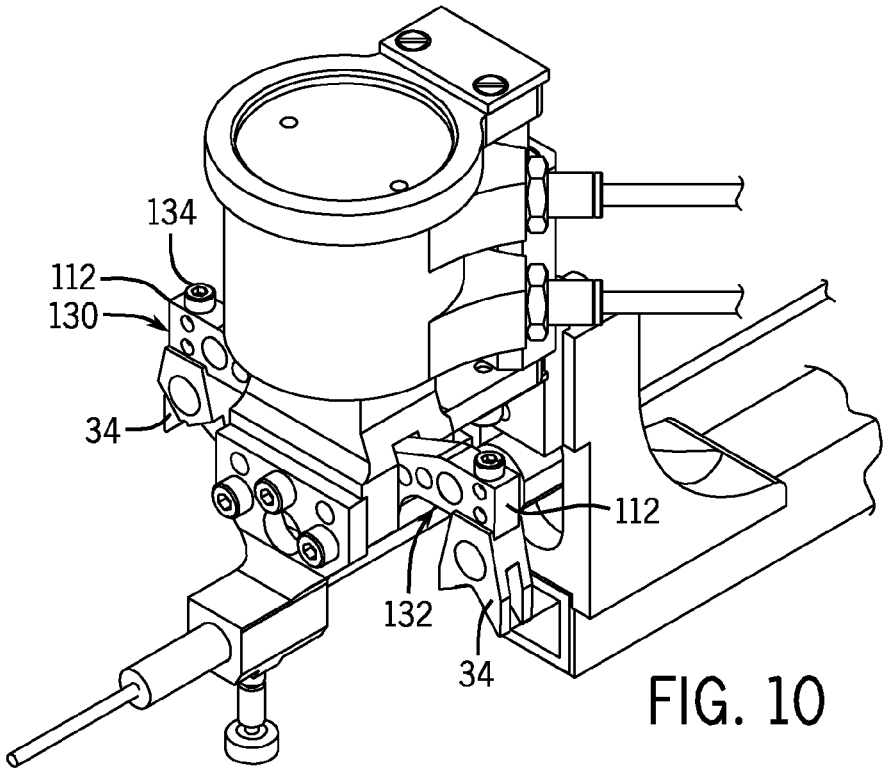
FIG. 10 is a view similar to FIG. 9 in a release position.

In the embodiment shown in FIGS. 9 and 10, the wire gripping assembly includes both a first lever arm 130 and a second lever arm 132. However, in the embodiments of FIGS. 9 and 10, the lever arms 130, 132 are slightly different than the lever arms 30, 32 shown in the first embodiment of FIGS. 5 and 6. In the second embodiment shown in FIGS. 9 and 10, both of the lever arms include the same first section 112. However, instead of including the horizontal, second section 114, the lever arms shown in FIGS. 9 and 10 include the gripper jaws 34 mounted directly to the first section 112 through the connector 134. As can be understood in FIGS. 9 and 10, the first sections 112 are each movable between the gripping position shown in FIG. 9 and the release position shown in FIG. 10.

Figure 11:
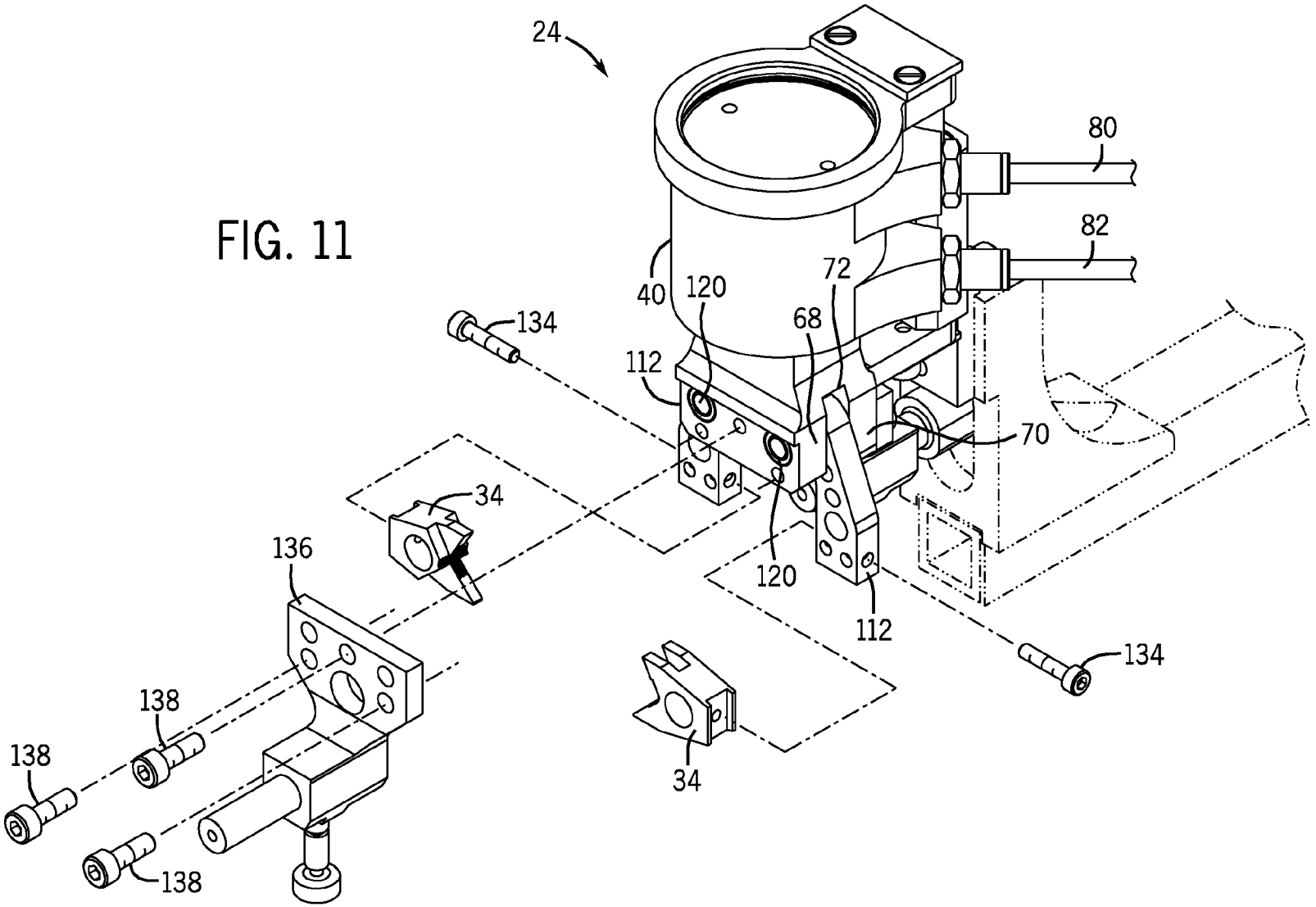
FIG. 11 is an exploded view of the second configuration of the wire gripping assembly shown in FIGS. 9 and 10.

As illustrated in FIG. 11, a wire guide 136 is mounted to the front wall 68 by a series of connectors 138. The wire guide 136 covers the pivot pins 120 in the same manner as the cover plate 126 shown in FIG. 7. As can be understood in a comparison of FIGS. 7 and 11, the wire gripping assembly 24 is identical in both configurations. However, the first and second lever arms 30, 32 are configured differently in the embodiment of FIGS. 7 and 11 to carry out different wire gripping and moving functions. The operation of the wire gripping assembly 24, and specifically the use of the moving rack member and rotating lever arms are identical in both embodiments.

Although the wire gripping assembly 24 shown in both configurations of the drawing figures includes an air cylinder, it is contemplated that the air cylinder could be removed and replaced with other types of drive mechanisms. As an example, an electronically activated solenoid could be utilized to move the rack member relative to the first and second lever arms 30, 32. Other types of driving arrangements are also contemplated as being within the scope of the present disclosure.

Further, although a source of pressurized air was shown and described as being coupled to the pair of supply hoses 80, 82, various other types of pressurized liquid could be utilized while operating within the scope of the present disclosure. Pressurized air is contemplating as being utilized in the preferred embodiment due to the availability and ease of use of pressurized air. However, other embodiments are contemplated as being within the scope of the present disclosure.

We claim:

1. A wire gripping assembly, comprising:

a drive cylinder having an open interior, a first fluid inlet and a second fluid inlet;

a drive piston movable within the open interior of the drive cylinder, wherein the drive piston is moved in a first direction by operation of the first fluid inlet, and further wherein the drive piston is moved in a second direction opposite to the first direction by operation of the second fluid inlet;

a rack member securely mounted to the drive piston and movable therewith;

a first lever arm and a second lever arm each having a first end pivotable relative to the drive cylinder, wherein the first end of each of the lever arms engages the rack member; and a gripper jaw formed on a second end of each of the lever arms, wherein the rack member is movable with the drive piston to selectively rotate the first and second lever arms between a release position and a gripping position.

2. The wire gripping assembly of claim 1 wherein the drive piston and the rack member are movable along a linear movement axis and the first and second lever arms are each pivotable about a pivot axis perpendicular to the movement axis.

3. The wire gripping assembly of claim 2 wherein the pivot axis of the first lever arm and the pivot axis of the second lever arm are located on opposite sides of the rack member.

4. The wire gripping assembly of claim 1 wherein the first end of each of the first and second lever aims includes a series of engagement teeth.

5. The wire gripping assembly of claim 4 wherein the rack member includes a series of drive teeth, wherein the engagement teeth formed on the first lever arm and the engagement teeth formed on the second lever arm mesh with the drive teeth.

6. The wire gripping assembly of claim 4 wherein each of the lever arms includes a radiused movement surface formed on the first end, wherein the movement surface includes the plurality of engagement teeth.

7. The wire gripping assembly of claim 1 wherein the drive piston includes an outer sealing member that engages an inner wall that defines the open interior of the drive cylinder, wherein the outer sealing member is located between the first fluid inlet and the second fluid inlet as the drive piston moves within the open interior.

8. The wire gripping assembly of claim 1 wherein the rack member passes through a central opening formed in a base wall of the drive cylinder.

9. The wire gripping assembly of claim 1 wherein the first and second lever arms are mounted such that the first and second lever arms move away from each other when the piston moves in a first direction and the first and second lever arms move toward each other when the piston moves in a second, opposite direction.

10. The wire gripping assembly of claim 1 wherein the gripper jaws are selectively removable from the lever arms.

11. A wire gripping assembly for gripping a wire, comprising:

a drive cylinder having an open interior, a first fluid inlet and a second fluid inlet;

a drive member including a rack member having a plurality of drive teeth, the drive member being movable along a linear movement axis within the open interior;

a first lever arm pivotable about a first end, the first end including a plurality of engagement teeth positioned to mesh with the drive teeth; and a second lever arm pivotable about a first end, the first end of the second lever arm including a plurality of engagement teeth positioned to mesh with the drive teeth, wherein movement of the drive member along the linear movement axis creates pivotable movement of both the first lever arm and the second lever arm, wherein the drive member is moved in a first direction along the linear movement axis by operation of the first fluid inlet, and further wherein the drive member is moved in the second direction along the linear movement axis opposite to the first direction by operation of the second fluid inlet.

12. The wire gripping assembly of claim 11 wherein the first lever arm is pivotable about a first pivot point and the second lever arm is pivotable about a second pivot point, wherein the first and second pivot points are located on opposite sides of the linear movement axis.

13. The wire gripping assembly of claim 11 wherein the first end of both the first and second lever arms includes a radius movement surface, wherein the radius movement surface includes the plurality of engagement teeth.

14. The wire gripping assembly of claim 11 wherein the drive member is an air cylinder including a piston movable within a cylinder body, wherein the rack member is securely attached to the piston.

15. The wire gripping assembly of claim 11 further comprising a gripper jaw attached to a second end of each of the first and second lever arms, wherein the gripper jaws engage the wire.

16. A wire gripping assembly, comprising:

a drive cylinder having an open interior, a first fluid inlet and a second fluid inlet;

a drive piston movably positioned within the open interior of the drive cylinder between the first fluid inlet and the second fluid inlet, wherein the drive piston is moved in a first direction by operation of the first fluid inlet, and further wherein the drive piston is moved in a second direction opposite to the first direction by operation of the second fluid inlet;

a rack member securely mounted to the drive piston and movable therewith, the rack member including a plurality of drive teeth, wherein the rack member is movable along a linear movement axis in the first and second direction;

a first lever arm including a first end including a plurality of engagement teeth positioned to mesh with the drive teeth, wherein the first lever arm is pivotable about a pivot axis extending through the first end of the first lever arm; and a second lever arm including a first end having a plurality of engagement teeth positioned to mesh with the drive teeth, wherein the second lever arm is pivotable about a pivot axis extending through the first end of the second lever arm, wherein movement of the rack member along the linear movement axis causes both the first lever arm and the second lever arm to pivot about their respective pivot axes.

17. The wire gripping assembly of claim 16 wherein the first lever arm is pivotable about a first pivot point and the second lever arm is pivotable about a second pivot point, wherein the first and second pivot points are located on opposite sides of the linear movement axis.

18. The wire gripping assembly of claim 16 wherein each of the first and second lever arms includes a radiused movement surface formed on the first end, wherein the movement surface includes the plurality of engagement teeth.

19. The wire gripping assembly of claim 16 wherein the first fluid inlet and the second fluid inlet are each coupled to a supply of pressurized air.

20. The wire gripping assembly of 19 wherein the drive piston includes an outer sealing member that engages an inner wall of the drive cylinder.

* * * * *